US009945135B2

(12) United States Patent
Aranburu Etxezarreta et al.

(10) Patent No.: US 9,945,135 B2
(45) Date of Patent: Apr. 17, 2018

(54) ANCHORING SYSTEM FOR ANCHORING A CLIMBING HEAD OF A CLIMBING SCAFFOLD TO A CONCRETE SLAB

(71) Applicant: ULMA C y E, S. Coop., Oñati (ES)

(72) Inventors: Angel Maria Aranburu Etxezarreta, Onati (ES); Aritz Zuloaga Agirrebalzategi, Onati (ES); Ander Egaña Urrutia, Onati (ES)

(73) Assignee: ULMA C Y E, S. COOP., Oñati (ES)

( * ) Notice: Subject to any disclaimer, the term of this patent is extended or adjusted under 35 U.S.C. 154(b) by 0 days.

(21) Appl. No.: 15/646,850

(22) Filed: Jul. 11, 2017

(65) Prior Publication Data

US 2018/0023308 A1 Jan. 25, 2018

(30) Foreign Application Priority Data

Jul. 21, 2016 (EP) ..... 16382354

(51) Int. Cl.
*E04G 5/04* (2006.01)
*E04G 3/28* (2006.01)

(52) U.S. Cl.
CPC ..... *E04G 5/04* (2013.01); *E04G 3/28* (2013.01); *E04G 2003/286* (2013.01)

(58) Field of Classification Search
CPC ..... E04G 5/04; E04G 3/28; E04G 2003/286
See application file for complete search history.

(56) References Cited

U.S. PATENT DOCUMENTS 1,570,226 A * 1/1926 Bosco ..... E04G 25/00 248/354.1
2,123,484 A * 7/1938 Mafera ..... F16M 7/00 254/104
4,439,961 A * 4/1984 Witte ..... E04G 13/00 52/126.1

(Continued)

FOREIGN PATENT DOCUMENTS

DE 29700648 U1 * 6/1997 ..... E04G 5/04
EP 2503077 A1 9/2012

(Continued)

OTHER PUBLICATIONS

European Search Report in corresponding European Patent Application No. 16382354.5, dated Oct. 17, 2016.

*Primary Examiner* — Jeanette E Chapman
(74) *Attorney, Agent, or Firm* — Edell, Shapiro & Finnan, LLC

(57) ABSTRACT

An anchoring system and method for anchoring a climbing head to a concrete slab. The anchoring system includes a support and adjustment means for adjusting the positioning of the support with respect to anchoring means of the support. The adjustment means includes a first element fixed to the support, a second element fixed to the anchoring means, both the first element and second element being coupled to one another through a plurality of respective teeth forming a laterally detachable attachment which allows varying the relative longitudinal position of the first element with respect to the second element through the engagement of the corresponding teeth (32, 36) regulating the positioning of the support with respect to the anchoring means.

14 Claims, 7 Drawing Sheets

(56) References Cited

U.S. PATENT DOCUMENTS

| | | | | | |
|---|---|---|---|---|---|
| 4,625,489 | A * | 12/1986 | Bogle | F16B 2/14 | 254/104 |
| 5,815,992 | A * | 10/1998 | Wells | F16B 19/02 | 248/188.2 |
| 8,701,827 | B2 | 4/2014 | Taylor | | |
| 8,943,765 | B2 * | 2/2015 | Danning | H02S 20/23 | 52/126.1 |
| 9,175,487 | B2 * | 11/2015 | Iturbe Beristain | E04G 21/16 | |
| 9,476,210 | B2 * | 10/2016 | Urzelai Ezkibel | E04G 11/28 | |
| 2006/0027726 | A1 * | 2/2006 | Keith | E04G 5/04 | 249/16 |
| 2016/0040441 | A1 * | 2/2016 | Dingier | E04G 3/28 | 248/241 |

FOREIGN PATENT DOCUMENTS

| | | | | |
|---|---|---|---|---|
| EP | 2990564 | A1 | 3/2016 | |
| FR | 2770554 | A1 * | 5/1999 | E04G 3/20 |
| FR | 2972016 | A1 * | 8/2012 | E04G 3/20 |
| GB | 32529470 | A * | 2/2016 | E04G 21/3247 |

* cited by examiner

ANCHORING SYSTEM FOR ANCHORING A CLIMBING HEAD OF A CLIMBING SCAFFOLD TO A CONCRETE SLAB

CROSS-REFERENCE TO RELATED APPLICATIONS

This application relates to and claims the benefit and priority to European Application No. EP16382354.5, filed Jul. 21, 2016.

TECHNICAL FIELD

The present invention relates to an anchoring system for anchoring a climbing head of a climbing scaffold to a concrete slab and an adjustment method for adjusting the positioning of the anchoring system for anchoring a climbing head of a climbing scaffold to a concrete slab.

BACKGROUND

Climbing scaffolds suitable for being fixed to a building under construction, both to vertical sections and concrete slabs of said building, are known in the prior art, the scaffold comprising struts arranged substantially vertical and parallel to one another, and climbing heads anchored to the vertical section or to the corresponding concrete slab through respective anchoring means, the climbing heads being suitable for guiding the respective strut in a substantially vertical climbing direction.

Due to the fact that sometimes both the vertical sections and the concrete slabs of said building are not correctly aligned with one another, and therefore the climbing heads cannot correctly guide the respective strut, regulation means for regulating the position of the climbing head with respect to the corresponding vertical section or the concrete slab are known in the prior art. In this sense, U.S. Publication No. 2012/0023839A1, for example, discloses an anchoring system comprising a support fixed to the concrete slab at a point away from the end of the concrete slab, and an arm slidable along the support in a linear direction along the support. The climbing head is fixed to the end of the arm, projecting from the end of the concrete slab.

U.S. Publication No. 2016/0440441A1 describes an anchoring system comprising a support fixed to the ground, a slidable part suitable for moving in a guided manner on the support parallel to the ground, and a device which allows movement of the slidable part, said device including a rotation/translation conversion transmission mechanism, said device being a self-locking device.

European Publication No. EP2503077A1 describes a self-climbing scaffold comprising adjustable supports at the ends of which the corresponding climbing head is fixed, the supports including displacement means for moving the supports with respect to the anchoring means through which the supports are fixed to the corresponding concrete slab. The displacement means comprise a rack and pinion transmission system which allows moving the support with respect to the anchoring means.

SUMMARY OF THE DISCLOSURE

Disclosed herein is an anchoring system for anchoring a climbing head of a climbing scaffold to a concrete slab and an adjustment method for adjusting the positioning of the anchoring system for anchoring a climbing head to the corresponding concrete slab.

One aspect relates to the anchoring system for anchoring a climbing head of a climbing scaffold to a concrete slab. The anchoring system includes a support configured for being fixed to the concrete slab through anchoring means, the climbing head being configured for being fixed to the support.

The anchoring system further includes adjustment means for adjusting the positioning of the support with respect to the anchoring means, said adjustment means comprising a first element which is fixed to the support and comprises a plurality of teeth alternating with a plurality of housings, a second element which is fixed to the anchoring means and comprises a plurality of teeth alternating with a plurality of housings, the plurality of housings of the first element and the plurality of housings of the second element being complementary to the plurality of teeth of the second element and to the plurality of teeth of the first element, at least part of the plurality of teeth of the first element and at least part of the plurality of teeth of the second element being coupled to one another. Both the first element and second element are coupled to one another through the respective teeth, said coupling being laterally detachable such that it allows varying the relative longitudinal position of the first element with respect to the second element through the engagement of the corresponding teeth, thereby adjusting the positioning of the support with respect to the anchoring means. Furthermore, the teeth of the first element and of the second element have a first area with a first width and a second area, closer to the respective element than the first area, with a second width smaller than the first width, such that the second element cannot be vertically detached due to said difference in widths, thereby preventing said element from falling or being lost when handing it.

Another aspect relates to the adjustment method for adjusting the positioning of the anchoring system of the respective climbing head to the respective concrete slab wherein, starting from an initial position in which the first element is fixed to the support and is coupled with respect to the second element through the respective teeth, the first element is laterally decoupled from the second element, then being longitudinally moved a specific length with respect to the first element and laterally coupled to the second element in a final position, forming another coupling which is moved said specific length with respect to the initial coupling.

An anchoring system and an adjustment method for adjusting the positioning of the anchoring system with respect to the concrete slab that allows correcting the positioning errors of the anchoring means embedded in the concrete slab in which the anchoring system of the climbing head is fixed, are thereby obtained in a simple and cost-effective manner.

These and other advantages and features will become evident in view of the drawings and the detailed description.

DETAILED DESCRIPTION

Figure 1:
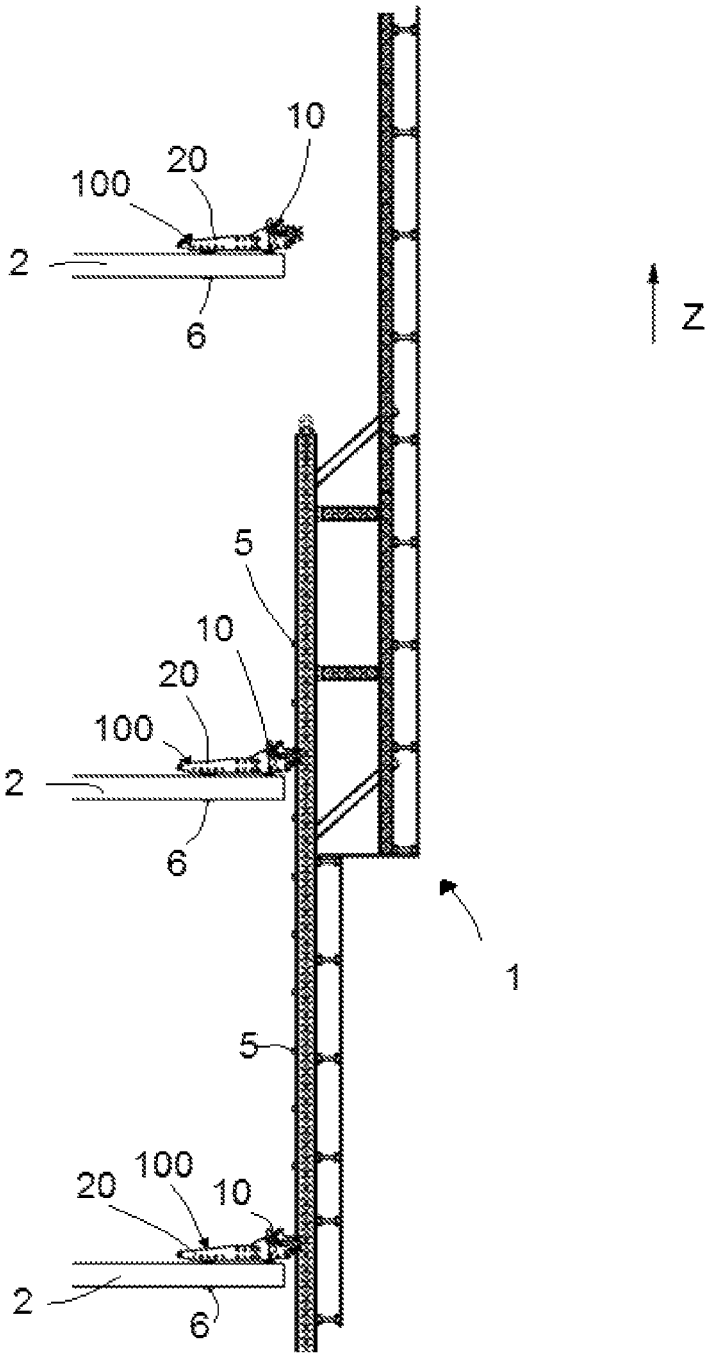
FIG. 1 shows a side view of a climbing scaffold according to one embodiment fixed to a building under construction comprising an anchoring system for anchoring climbing heads of the scaffold to a concrete slab of said building.
Figure 2:
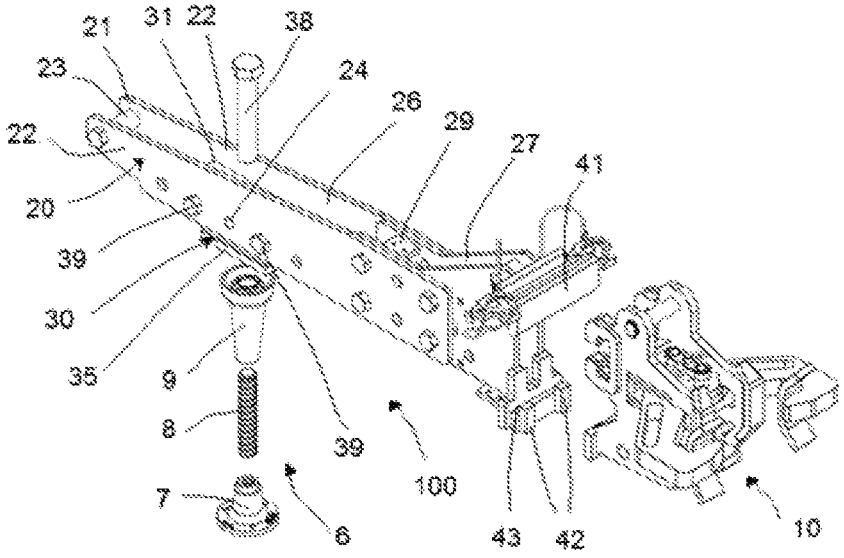
FIG. 2 shows an exploded view of the anchoring system shown in FIG. 1.
Figure 3:
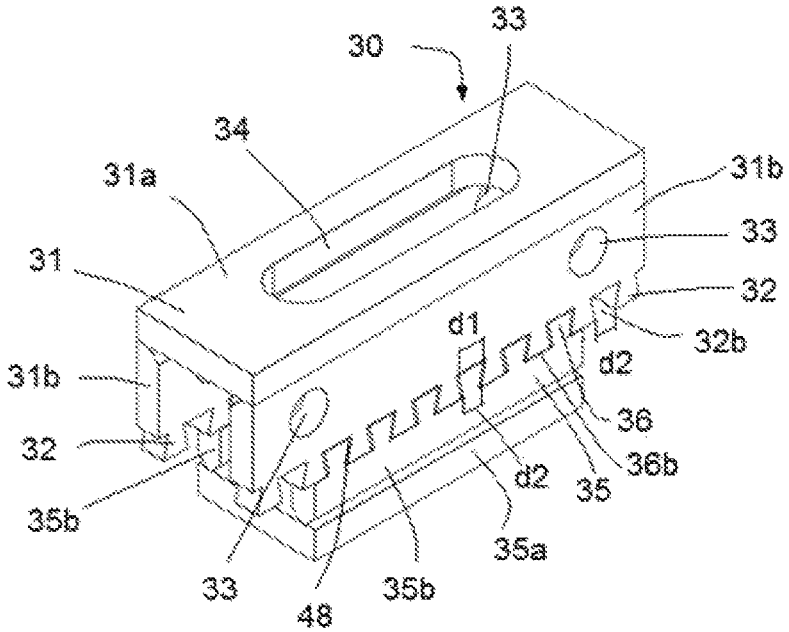
FIG. 3 shows a detailed view of the adjustment means comprised in the anchoring system shown in FIG. 1.
Figure 4:
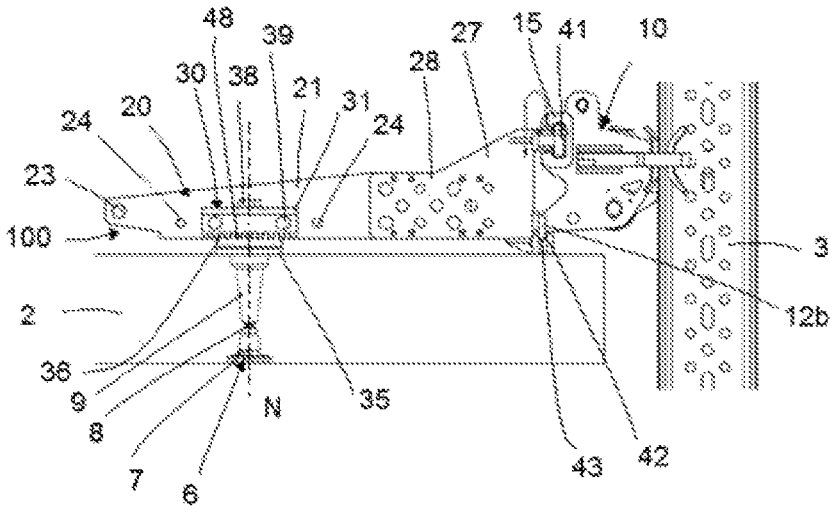
FIG. 4 shows a detailed side view of the anchoring system shown in FIG. 1 in a neutral position.

FIG. 1 shows a climbing scaffold 1 fixed to a building under construction, particularly to concrete slabs 2 of said building. The climbing scaffold comprises struts 3, climbing heads 10 which are suitable for guiding the respective strut 3 in a substantially vertical climbing direction Z, a work platform 4 supported by the struts 3 and anchoring systems 100 anchoring each climbing head 10 to the corresponding concrete slab 2 according to the invention.

Each strut 3 is formed by at least one profile having a substantially H-shaped cross-section and further comprises bearing elements 5 partially housed inside the corresponding H-shaped profile, each of which cooperates with the corresponding climbing head 10 for engaging the corresponding strut 3 and for the climbing of the climbing scaffold 1.

The anchoring system 100 comprises a support 20 fixing the respective climbing head 10 to the concrete slab 2 and adjustment means 30 for adjusting the positioning of the support 20 with respect to the anchoring means 6. The adjustment means 30 for adjusting the positioning of the support 20 is intended for correcting, with respect to an end of the slab 2, possible errors that may occur in the positioning of the anchoring means 6 embedded in the concrete. The anchoring means 6 is known in the prior art so a detailed description thereof is not considered necessary. Said anchoring means 6 comprise an anchoring cone 9, an anchoring foot 7 and a threaded rod 8 through which the anchoring cone 9 is fixed to the anchoring foot 7, the anchoring cone 9, the anchoring foot 7 and the threaded rod 8 being embedded in the concrete.

The support 20 comprises two plates 22 arranged substantially parallel to one another and spaced apart through spacers 23 and 29 defining a cavity 26 in which the adjustment means 30 is at least partially housed. In the embodiment shown in the drawings, the support 20 comprises a first part 21 including the two plates 22 and a second part 27 including two additional plates 28 substantially parallel to one another and also spaced apart by the corresponding spacers 29. The plates 22 of the first part 21 are longitudinally fixed to the additional plates 28 of the second part 27. Particularly, the additional plates 28 of the second part 27 are partially housed in the cavity 26, screwed to the plates 22 of the first part 21.

In the embodiment shown in the drawings, the climbing head 10 and the support 20 are coupled to one another by means of a transverse guide 41 arranged in the second part 27 of the support 20 and at least one hook 15 which embraces the transverse guide 41 and is comprised in the climbing head 10, the hook 15 and the transverse guide 41 being slidable with respect to one another in order to laterally detach the climbing head 10 with respect to the support 20. In other embodiments not shown in the drawings, the transverse guide 41 can be included in the climbing head 10 whereas the hook 15 or the hooks 15 would be included in the second part 27.

In the embodiment shown in the drawings, the second part 27 of the support 20 comprises the transverse guide 41 at the end opposite the screwed attachment with the first part 21 of the support 20 whereas the climbing head 10 comprises two hooks 15 embracing said transverse guide 41. The transverse guide 41 comprises a profile having a substantially T-shaped section which is embraced by the hooks 15, each hook 15 including a geometry complementary to the profile of the transverse guide 41. The transverse guide 41 can be an integral part of the second part 27 of the support 20 or can be attached to said second part 27 through any known fixing method, such as welding, for example.

Furthermore, the second part 27 of the support 20 comprises at least one projection 42 on which a lower end **12*b* of the climbing head 10 is supported, said projection 42 supporting the climbing head 10. In this manner, most of the stresses to which the climbing head 10 is subjected are supported by the anchoring cone 9 and by the projection 42, the stresses supported by the transverse guide 41 being minimized. Particularly, as a result of the projection 42, the transverse guide 41 only supports horizontal loads, said transverse guide 41 being prevented from twisting. The projection 42 has a geometry such that it demarcates a housing 43 in the transverse direction, i.e., in the direction of detaching the climbing head 10, in which the lower end 12*b* of the climbing head 10 is partially housed. In the embodiment shown in the drawings, the support 20 comprises two projections 42**.

In addition, the adjustment means 30 comprises a first element 31 which is fixed to the support 20 and comprises a plurality of teeth 32 alternating with a plurality of housings **32*b*, and a second element 35 which is fixed to the anchoring means 6 and comprises a plurality of teeth 36 alternating with a plurality of housings 36*b*, the plurality of housings 32*b* of the first element 31 being complementary to the plurality of the teeth 36 of the second element 32 and the plurality of housings 36*b* of the second element 35 being complementary to the plurality of teeth 32 of the first element 31, at least part of the plurality of teeth 32 of the first element 31 and at least part of the plurality of teeth 36 of the second element 35 being coupled to one another. The attachment between the first element 31 and the second element 35 is laterally detachable such that it allows varying the relative longitudinal position of the first element 31 with respect to the second element 35 through the engagement of the corresponding teeth 32 of the first element 31 and the corresponding teeth 36 of the second element 35, correcting the positioning error of the anchoring cone 2 with respect to the end of the slab 2. Furthermore, the teeth 32 and 36 have a first area with a first width d1 and a second area, closer to the respective element 31 or 35 than the first area, with a second width d2 smaller than the first width d1 such that it is not possible to decouple the second element 35 with respect to the first element 31** in the vertical direction due to said difference in widths, because the narrower area retains the wider area in said vertical direction.

In the embodiment shown in the drawings, the housings **32*b* of the first element 31 and the housings 36*b* of the second element 35 are formed by the space demarcated by respective contiguous teeth 32 and 36**.

In the embodiment shown in FIGS. 2 to 8, the first element 31 and the second element 35 are coupled forming a dovetail attachment 48, 49 and 50. The plurality of teeth 32 of the first element 31 and the plurality of teeth 36 of the second element 35 have a trapezoidal geometry. Likewise, the plurality of housings 32*b* of the first element 31 and the plurality of housings 36*b* of the second element 32 have a geometry respectively complementary to the plurality of teeth 36 of the second element 35 and to the plurality of teeth of the first element 31, with dimensions such that it allows lateral movement of the first element 31 with respect to the second element 35 and blocks the decoupling of both elements 31 and 32 in the vertical direction. In this manner, taking into account that the first element 31 of the adjustment means 30 is fixed to the support 20, it prevents the second element 35 from being able to fall or from being lost during transport, assembly or handling by the operator. In this embodiment, the housings 32*b* and 36*b* of the first element 31 and of the second element 35 are formed by the space demarcated by respective contiguous teeth 32 and 36.

Figure 5:
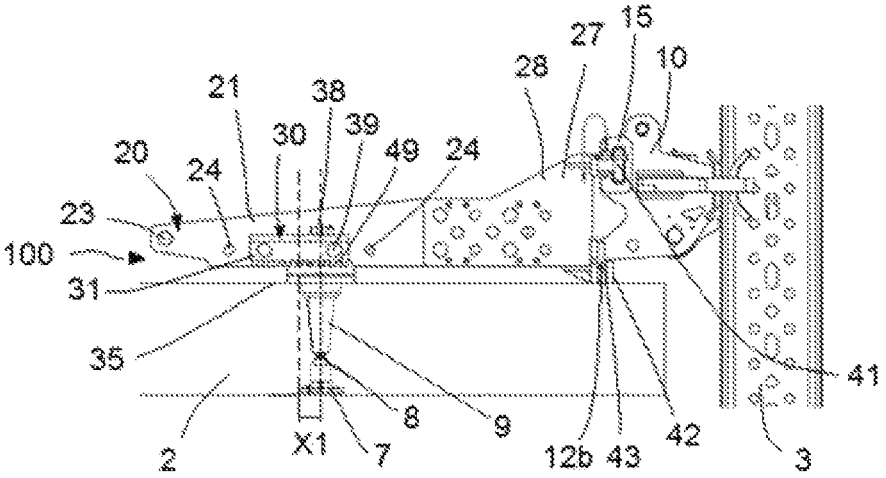
FIG. 5 shows a detailed side view of the anchoring system shown in FIG. 1 in a first corrected position.
Figure 6:
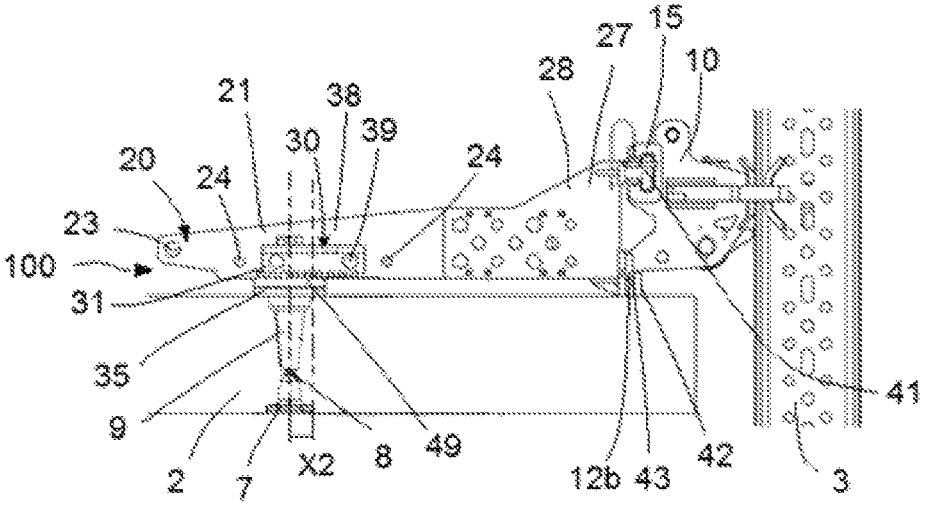
FIG. 6 shows a detailed side view of the anchoring system shown in FIG. 1 in a second corrected position.

The first element 31 comprises a base 31*a* and side walls 31*b* substantially orthogonal to the base 31*a* including the plurality of teeth 32, and the second element 35 comprises a base 35*a* including a hole (not depicted) and side walls 35*b* substantially orthogonal to the base 35*a* including the plurality of teeth 36. The plurality of teeth 32 and 36 alternating with the plurality of housings 32*b* and 36*b* respectively extend longitudinally at the ends of the respective side walls 31*b* and 35*b* of the first element 31 and of the second element 35, at least part of the plurality of teeth 32 and 36 of the first element 31 and of the second element 35 being able to engage one another in different relative longitudinal positions, such that the first element 31 and the second element 35 can be coupled to one another, moved specific distances X1 and X2 as shown in FIGS. 5 and 6, starting from a neutral position N shown in FIG. 4.

Fine adjustment of the support 20 with respect to the anchoring means 6 is obtained by means of the plurality of teeth 32 and 36 forming the corresponding coupling, particularly the corresponding dovetail attachment 48, 49 and 50. According to one embodiment each dovetail attachment 48, 49 and 50 formed includes at least four teeth 32 in the first element 31 and four teeth 36 in the second element 35 that engage or overlap one another, supporting the shear forces to which the anchoring system 100 is subjected.

The first element 31 and the second element 35 are screwed to the anchoring cone 9 through a screw 38. The first element 31 comprises a longitudinal groove 34 which allows varying the relative longitudinal position of the first element 31 with respect to the second element 35, i.e., it allows engaging the plurality of teeth 32 and 36 of the first element 31 and of the second element 35 with one another in different relative longitudinal positions and then again fixing the first element 31 and the second element 35 to the anchoring cone 9. The screw 38 goes through the longitudinal groove 34 of the first element 31 and the hole of the second element 35, fixing the adjustment means 30 to the anchoring cone 9.

Figure 7:
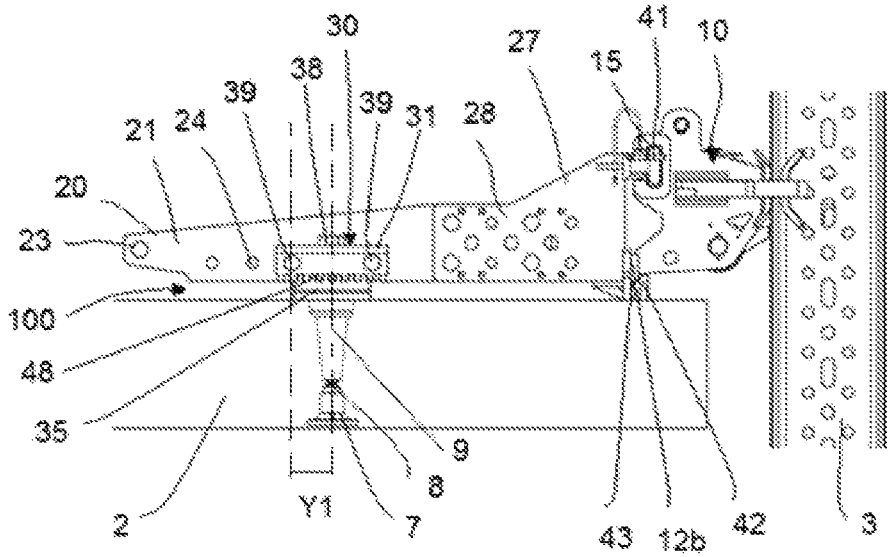
FIG. 7 shows a detailed side view of the anchoring system shown in FIG. 1 in a fourth corrected position.
Figure 8:
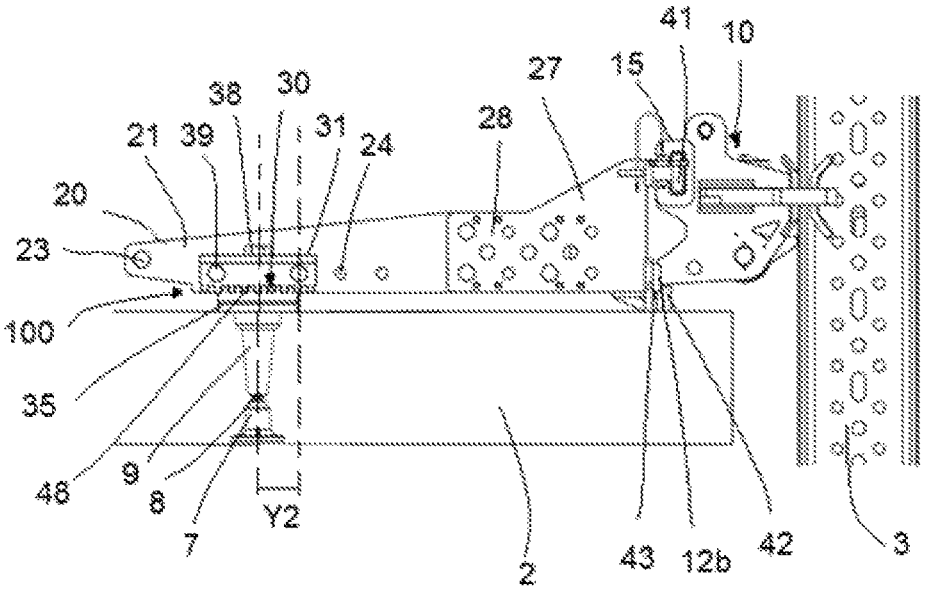
FIG. 8 shows a detailed side view of the anchoring system shown in FIG. 1 in a fifth corrected position.

In addition, the first element 31 is laterally fixed to the support 20, the adjustment means 30 therefore comprising adjustment holes 24 in the support 20 through which the first element 31 is fixed to the support 20. Said adjustment holes 24 are distributed in the longitudinal direction of the support 20 and allow varying the relative longitudinal position of the first element 31 with respect to the support 20. The first element 31 includes holes 33 going through the corresponding side walls 31*b*, the first element 31 being fixed to the support 20, particularly to the first part 21 of the support 20, through the corresponding screws 39 going through the holes 24 of the support 20 and the respective holes 33 of the first element 31. In this manner, it allows an additional adjustment of the positioning of the support 20 with respect to the anchoring means 6 as shown in FIGS. 7 and 8. This additional adjustment is a coarser adjustment than that obtained through the dovetail attachments. According to one embodiment through the dovetail attachments an adjustment of +/−20 mm is obtained on each side of the neutral position shown in FIG. 4 until reaching a maximum adjustment of +/−40 mm in the positions included in FIGS. 5 and 6, whereas through the adjustment holes 24 of the support 20 an adjustment of +/−62.5 mm is obtained on each side of the neutral position in the positions shown in FIGS. 7 and 8.

In addition, another aspect of the invention relates to the adjustment method for adjusting the positioning of the anchoring system 100 for anchoring the corresponding climbing head 10 to the corresponding concrete slab 2, particularly for adjusting the support 20 with respect to the anchoring means 6. Starting from an initial position (position N) in which the first element 31 is fixed to the support 20 and is coupled with respect to the second element 35 through the engagement of at least part of the plurality of teeth 36 of the second element 35 with at least part of the plurality of teeth 32 of the first element 31, the first element 31 is laterally decoupled from the second element 35, then being longitudinally moved a specific length X1 or X2, for example, with respect to the first element 31, and subsequently laterally coupled to the second element 35 in a final position (corrected position) forming another coupling 49 and 50 which is moved respective length X1 or X2 with respect to the initial coupling 48. In the embodiment shown in the drawings, the initial position corresponds with the neutral position shown in FIG. 4, in which the first element 31 is coupled through the corresponding dovetail attachment 48, centered with respect to said second element 35, the first element 31 in turn being screwed to the support 20 centered with respect to the adjustment holes 24 of the support 20. In this manner, the operator quickly knows the original position in which the support 20 must be anchored to the slab 2, and in the event that this cannot be done because the anchoring cone 9 is moved from the correct position, the corresponding adjustment will be initiated.

To laterally decouple the first element 31 and the second element 35 from one another, the screw 38 going through the first element 31 and the second element 35 and keeping both the first element 31 and second element 35 fixed to the anchoring cone 9 is released. Once the corresponding teeth 32 of the first element 31 have been coupled with the corresponding teeth 36 of the second element 31 in the new position (corrected position), forming the moved coupling 49 or 50, particularly the moved dovetail attachment 49 or 50, said first element 31 and second element 35 are fixed to the anchoring cone 9 through the screw 38.

If the positioning error of the anchoring cone 9 with respect to the end of the concrete slab 2 is greater than that which can be corrected with the adjustment obtained through the coupling between at least part of the plurality of teeth 32 of the first element 31 and at least part of the plurality of teeth 36 of the second element 35, the first element 31 is released from the support 20, i.e., the screws 39 keeping the first element 31 fixed to the support 20 are loosened, said support 20 being moved a length Y1 or Y2, for example, to the new position (corrected position), and the first element is again fixed to the support 20 in said new position.

Subsequently, if needed, a finer adjustment can again be carried out through the couplings between the plurality of teeth 32 and 36 as described in detail above.

Figure 9:
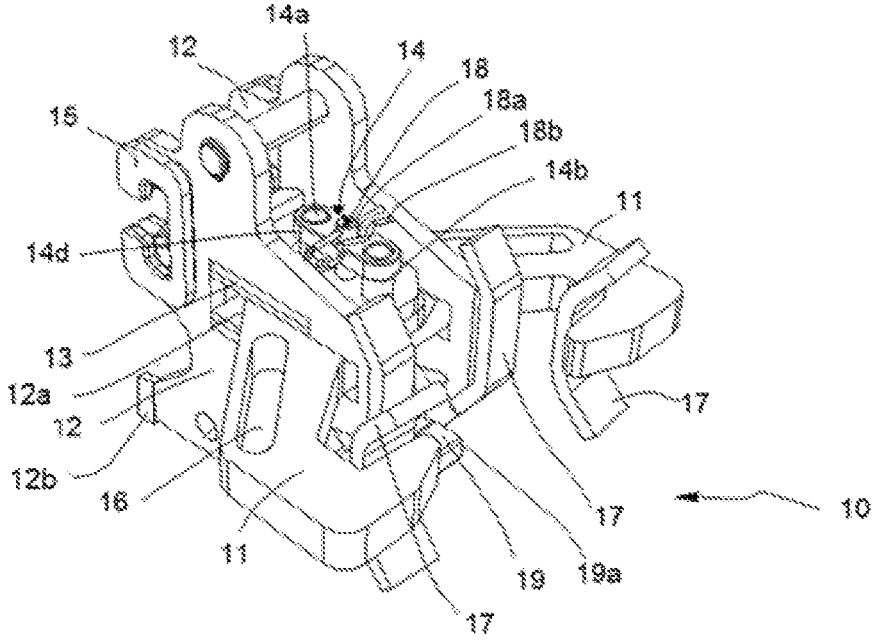
FIG. 9 shows a perspective view of the climbing head shown in FIG. 1.
Figure 10:
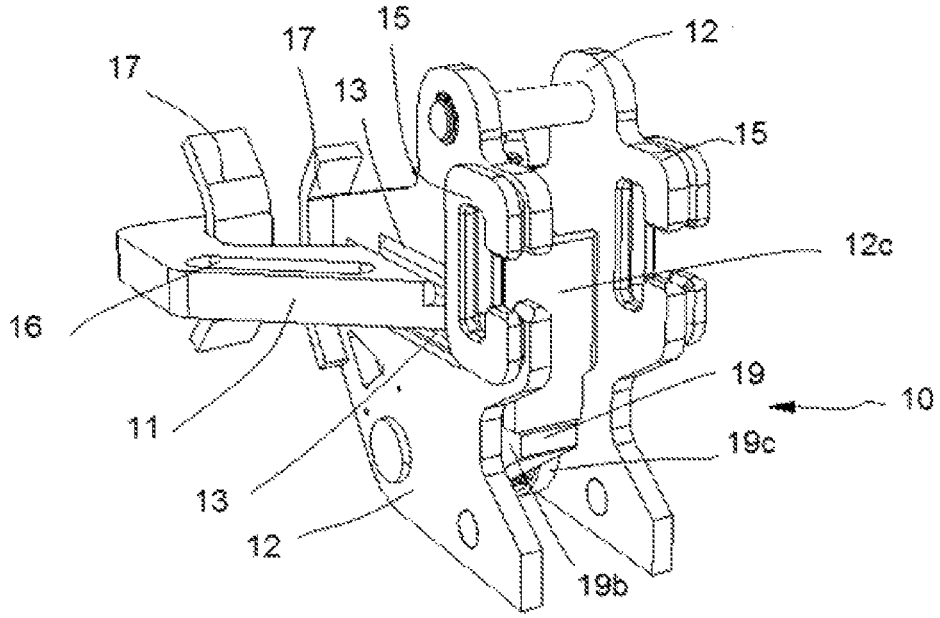
FIG. 10 shows another perspective view of the climbing head shown in FIG. 1.

In addition, the climbing head 10, shown in detail in FIGS. 9 and 10, includes claws 11 configured for holding the corresponding strut 3, which in a working position allow the guided movement of the strut 3 while the climbing scaffold 1 climbs in the climbing direction Z, and comprises, in addition to the two claws 11, side walls 12 arranged substantially parallel to one another, and attachment plates 13 of said side walls 12, arranged substantially orthogonal to the side walls 12, the two claws 11 being coupled to one another and to the attachment plates 13 in a pivotable manner through a double safety bolt 14. Each claw 11 goes through the corresponding side wall 12 through a groove 12*a* in the corresponding side wall 12. When the climbing head 10 is in the working position, the claws 11 are closed, demarcating a housing through which the respective strut 3 is moved in the climbing direction Z. In said position, the claws 11 embrace the strut 3, particularly a flange of the strut 3, guiding the movement of the strut 3. To that end, both the claws 11 and the side walls 12 comprise guides 17 in the climbing direction Z collaborating in guiding the strut 3. Said guides 17 together with the claws 11 demarcate the housing.

In the working position, the double safety bolt 14 goes through the claws 11 and the attachment plates 13, keeping the claws 11 closed. The double safety bolt 14 comprises two arms 14*a* and 14*b* having different lengths such that when the operator wants to open the claws 11, it is necessary to pull the double safety bolt 14 vertically upwards until one of the arms 14*a* and 14*b* is released from the claws 11 and from the respective attachment plates 13, and then pull handles 16 arranged in each claw 11 pivoting them with respect to the other arm 14*a* of the double safety bolt 14 in order to open same. The longer arm 14*a* includes at its free end a Seeger ring (not shown in the drawings) to prevent the detachment thereof. Furthermore, to prevent accidentally pulling the double safety bolt 14, the climbing head 10 includes safety means 18 including a rod 18*a* projecting from one of the attachment plates 13 going through the double safety bolt 14, particularly a plate 14*d* which attaches the arms 14*a* and 14*b* of said safety bolt 14 and a retainer 18*b* which is arranged transversely going through the rod 18*a* and abutting against the plate 14*d* of the double safety bolt 14, such that the operator must remove the retainer 18*b* from the rod 18*a* before pulling the double safety bolt 14 in order to be able to open the claws 11.

Each climbing head 10 further comprises a rocker arm 19 pivotable with respect to an axis of rotation substantially orthogonal to the pivoting axis of the claws 11, coupled to the side walls 12. The rocker arm 19 is suitable for pivoting between the working position in which said rocker arm 19 supports the bearing element 5 for bearing the corresponding strut 3, and a climbing position in which the rocker arm 19 allows the movement of the strut 3 in the climbing direction Z. To that end, the rocker arm 19 comprises a front part 19*a* which in the working position is partially housed in the housing demarcated by the claws 11, such that it abuts against the respective bearing element 5 preventing the respective strut 3 from moving down, and a rear part 19*b* which in the working position abuts against a stop 12*c* coupled to the side walls 12. In the climbing position, as the respective strut 3 moves upwards, the respective bearing elements 5 hit the front part 19*a* of the respective rocker arms 19, forcing them to rotate to the position in which they allow the upward movement of the strut 3. The front part 19*a* rotates integrally with the rear part 19*b* of the rocker arm 19 such that when the rocker arm 19 rotates due to the action of the respective bearing element 5, the rear part 19*b* is spaced from the stop 12*c* coupled to the side walls 12. Once the bearing element 5 has overcome the corresponding rocker arm 19, it returns to the working position as a result of a spring 19*c* coupled to the rotating shaft 20.

What is claimed is:

1. An anchoring system for anchoring a climbing head of a climbing scaffold to a concrete slab, the anchoring system comprising:

a support configured for being fixed to the concrete slab through an anchoring assembly, the support configured for being coupled to the climbing head; and an adjustment assembly for adjusting the longitudinal position of the support with respect to the anchoring assembly, the adjustment assembly comprising:

a first element fixed to the support and including a first plurality of teeth alternating with a first plurality of housings; and a second element disposed below the first element and configured to be fixed to the anchoring assembly the second element including a second plurality of teeth alternating with a second plurality of housings, at least some of the first plurality of teeth residing in at least some of the second plurality of housings, at least some of the second plurality of teeth residing in at least some of the first plurality of housings, the first and second plurality of teeth and first and second plurality of housings being shaped to allow a lateral detachment and lateral attachment of the first and second plurality of teeth while preventing a vertical detachment of the first and second plurality of teeth, the lateral detachment of the first and second plurality of teeth permitting the first element to be detached and subsequently reattached to the second element to allow varying the longitudinal position of the support with respect to the anchoring assembly.

2. The anchoring system according to claim 1, wherein each of the first and second plurality of teeth have a first area with a first width and a second area with a second width smaller than the first width.

3. The anchoring system according to claim 1, wherein each of the first and second plurality of teeth have a trapezoidal geometry.

4. The anchoring system according to claim 1, wherein the first and second plurality of teeth and the first and second plurality of housings form a dovetail attachment.

5. The anchoring system according to claim 1, wherein the first and second plurality housings are formed by a space demarcated by the respective first and second plurality of teeth.

6. The anchoring system according to claim 1, wherein the first element is attached to the support by one or more fasteners that extend through holes formed in the first element and the support, the support including a plurality of longitudinally spaced holes that facilitate an attachment of the first element at different longitudinal positions in the support allowing an additional adjustment of the positioning of the support with respect to the anchoring assembly.

7. The anchoring system of claim 1, wherein the first element is longitudinally movable with respect to the second element by a first maximum adjustment and the first element is longitudinally movable with respect to the support by a second maximum adjustment, the second maximum adjustment being greater than the first maximum adjustment.

8. The anchoring system according to claim 1, further comprising the anchoring assembly, the anchoring assembly including an anchoring cone, the first element and the second element being attached to the anchoring cone by a fastener that extends through a longitudinal groove of the first element, the longitudinal groove allowing varying the relative longitudinal position of the first element with respect to the second element.

9. The anchoring system according to claim 8, wherein the first element comprises a base which includes the longitudinal groove and side walls which include the first plurality of teeth and the first plurality of housings, and the second element comprises a base including a hole and side walls which include the second plurality of teeth and the second plurality of housings, the fastener passing through the longitudinal groove of the first element and the hole of the second element fixing the adjustment assembly to the anchoring cone.

10. The anchoring system according to claim 9, wherein the base and side walls of the first element are arranged orthogonal to one another, and the base and side walls of the second element are arranged orthogonal to one another.

11. The anchoring system according to claim 1, wherein the support includes first and second spaced apart plates arranged substantially parallel to one another, the adjustment assembly being housed in a cavity located between the first and second spaced apart plates.

12. The anchoring system according to claim 11, wherein the support comprises a first part including the first and second spaced apart plates and a second part including additional plates, the first and second spaced apart plates of the first part being fixed to the additional plates of the second part, the second part including features for coupling the climbing head to the support.

13. The anchoring system according to claim 12, further comprising the climbing head, the second part of the support having an end with a transverse guide collaborating with at least one hook included in the climbing head for coupling the climbing head to the support.

14. The anchoring system according to claim 13, wherein the end of the second part includes at least one projection on which the climbing head is supported.

* * * * *